US006463867B2

(12) United States Patent
Kato

(10) Patent No.: US 6,463,867 B2
(45) Date of Patent: Oct. 15, 2002

(54) HEADGEAR VISOR HOLDING DEVICE FOR USE WITH SEWING MACHINE

(75) Inventor: Masato Kato, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/941,678

(22) Filed: Aug. 30, 2001

(65) Prior Publication Data

US 2002/0046687 A1 Apr. 25, 2002

(30) Foreign Application Priority Data

Oct. 20, 2000 (JP) ..... 2000-320938

(51) Int. Cl.[7] ..... D05C 9/04
(52) U.S. Cl. ..... 112/103; 112/470.14
(58) Field of Search ..... 112/103, 470.14, 112/475.11, 155; 38/102.91

(56) References Cited

U.S. PATENT DOCUMENTS

| | | | | | |
|---|---|---|---|---|---|
| 4,598,488 | A | * | 7/1986 | Inteso | 112/103 |
| 4,665,844 | A | * | 5/1987 | Shibata | 112/103 |
| 5,415,116 | A | * | 5/1995 | Nishio | 112/103 |
| 5,701,831 | A | | 12/1997 | Morita | |
| 5,937,774 | A | * | 8/1999 | Hayashi | 112/103 |

* cited by examiner

*Primary Examiner*—Ismael Izaguirre
(74) *Attorney, Agent, or Firm*—Oliff & Berridge, PLC

(57) ABSTRACT

A visor support supports a cap visor at an angle with respect to a cap holder of a cap holding device for use with a sewing machine. The angle of inclination of the visor support can be adjusted. This prevents, when the cap holder is moved, contact between the cap visor and an arm of the embroidery machine, which causes a partially shiny and shabby appearance of the visor or damage to the visor, and prevents deformation of the visor, which reduces the commercial value of the cap.

21 Claims, 17 Drawing Sheets

RELATED ART

RELATED ART

HEADGEAR VISOR HOLDING DEVICE FOR USE WITH SEWING MACHINE

BACKGROUND OF THE INVENTION

1. Field of Invention

The invention relates to a headgear holding device for use with a sewing machine.

2. Description of Related Art

A conventional multiple-needle embroidery machine is provided with a headgear holder that can move along a horizontal axis intersecting the path of a vertically moving sewing needle and can rotate about the horizontal axis. A headgear, such as a cap, is set on the headgear holder with its visor facing upward.

There are two conventional methods for setting a headgear on the headgear holder. In one method, as shown in FIG. 17, a sewing needle 402 is supported by an arm 401 of an embroidery machine so as to be vertically movable, and a headgear holder (not shown) is mounted to the embroidery machine so as to be movable along a horizontal axis intersecting the path of the vertically moving sewing needle 402 and to be rotatable about the horizontal axis. A cap 403 is set on the headgear holder with its visor 404 facing upward. In this case, the visor 404 makes contact with and rubs against the arm 401 when the headgear holder is moved and, as a result, the surface of the visor 404 becomes partially shiny, shabby, or damaged.

In the other method, as shown in FIG. 18, a visor support 405 is fixed to a headgear holder so as to support the visor 404 of the cap 403 at an angle. The visor 404 of the cap 403 is forcibly bent with respect to the visor support 405. The tip of the visor 404 is lowered so that contact between the visor 404 and the arm 401 is prevented during sewing. In this case, because the visor 404 is greatly deformed, the cap remains deformed after sewing and, as a result, its commercial value is reduced.

SUMMARY OF THE INVENTION

The invention provides a headgear holding device that addresses the forgoing problems and prevents, when the headgear holding device is moved, contact between the visor of a cap set in the headgear holding device and an arm of an embroidery machine, which causes a shiny and shabby appearance of the visor or damage to the visor, and also prevents deformation of the visor, which reduces the commercial value of the cap.

According to one aspect of the invention, a headgear holding device of a sewing machine includes a headgear holder that holds a headgear with a visor while being moved along a horizontal axis intersecting a path of a vertically moving sewing needle and rotated about the horizontal axis; a visor support member that supports the visor of the headgear held on the headgear holder at an angle with respect to the horizontal axis; and an angle adjusting member that adjusts an angle of inclination of the visor supported by the visor support member.

In this headgear holding device of the sewing machine, the bending angle of the visor can be adjusted by adjusting the angle of inclination of the visor support member. Accordingly, when the headgear holding device is moved, the visor of the cap set in the headgear holding device will not contact or rub against the arm of the sewing machine. As a result, the visor is prevented from becoming partially shiny, shabby, or damaged, and the commercial value of the cap is not reduced.

Additionally, the angle adjusting member has a fixed member fixed to the headgear holder and a pivot member pivotably attached to the fixed member. With this structure, the visor can be supported by the visor support member at an arbitrary angle with respect to the horizontal axis.

BRIEF DESCRIPTION OF THE DRAWINGS

A preferred embodiment of the invention will be described with reference to the following figures wherein.

DETAILED DESCRIPTION OF PREFERRED EMBODIMENTS

A preferred embodiment of the invention will be described in detail with reference to the accompanying drawings.

In the preferred embodiment, the invention is applied, by way of example, to a cap holding device used in a multiple-head embroidery machine. The cap holding device holds a cap so as to allow the embroidery machine to form embroidery stitches on the cap.

Figure 1:
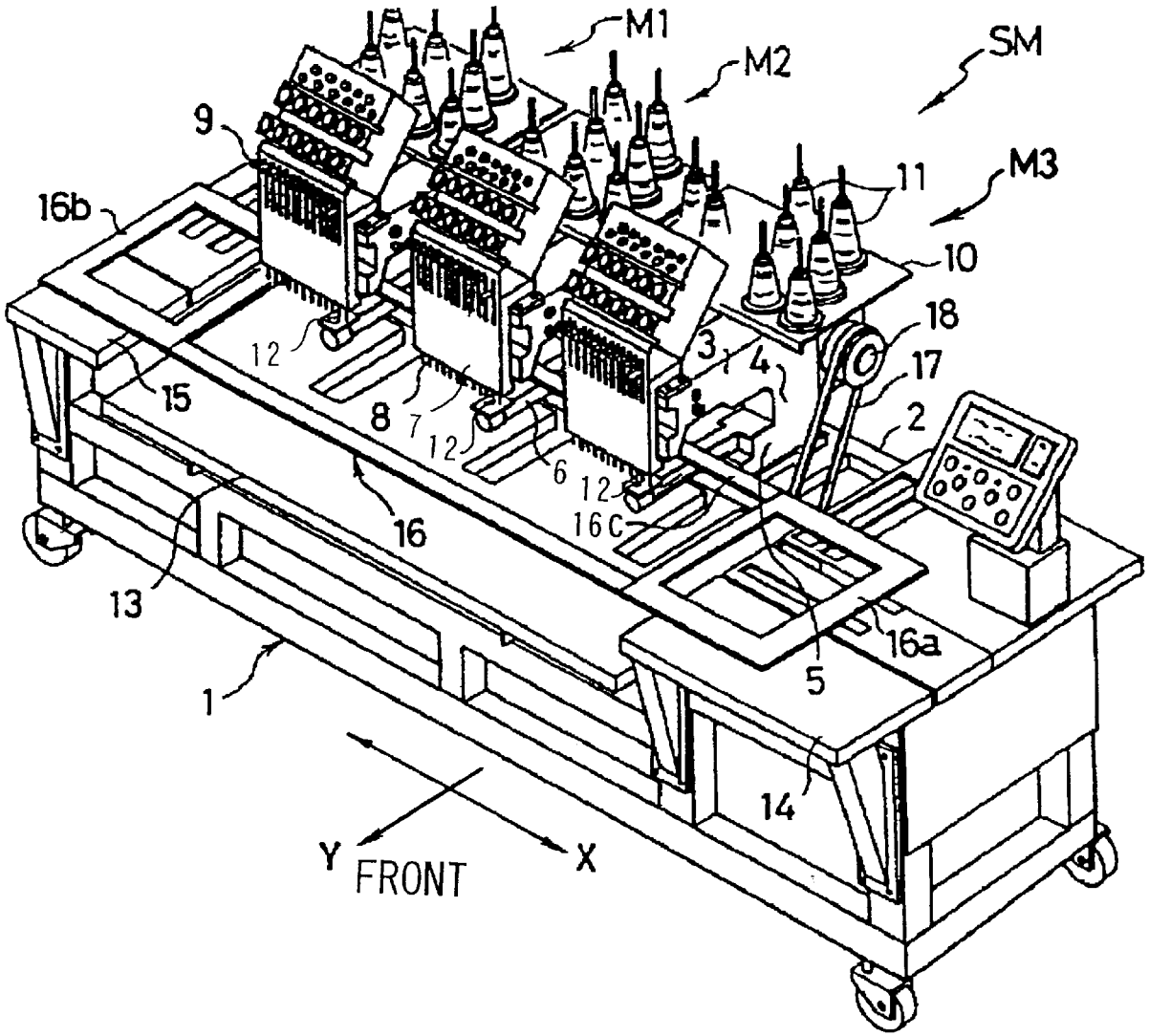
FIG. 1 is a general perspective view of a multiple-head embroidery machine according to one embodiment of the invention.

As shown in FIG. 1, a multiple-head type embroidery machine SM includes a base 1 extending in a lateral direction (X direction), and a substantially rectangular support plate 2 disposed at an upper rear side of the base 1 so as to extend in the X direction. On the support plate 2, three embroidery machines M1–M3 are arrayed side by side in the X direction. The embroidery machines M1–M3 have the same structure.

Each of the embroidery machines M1–M3 has an arm 3 that supports, at its free or front end, a needle bar case 7. The needle bar case 7 is movable horizontally in the X direction and supports twelve needle bars such that they are vertically movable and supports twelve thread take-up levers 9 such that they are vertically swingable. The arm 3 extends horizontally toward an arm support 4. The arm support 4 continues, at its lower end, to a main bed 5, which is secured onto the support plate 2. A cylinder bed 6 extends forward from the front end of the main bed 5. Provided at the distal end (front end) of the cylinder bed 6 are a thread-loop taker and other parts.

As shown in FIG. 1, a sewing needle 8 is secured to the lower end of each of the twelve needle bars. Twelve-color embroidery threads are respectively supplied, from twelve spools 11 held at a spool stand 10, to the twelve sewing needles 8. The needle bar case 7 is moved in the X direction so that one of the sewing needles 8 is placed at a sewing position opposed to a needle hole 12 provided at the distal end of the cylinder bed 6. When one of the needle bars is selected by the shift of the sewing needles 8, only the selected needle bar and the thread take-up lever 9, connected to the selected needle bar, are allowed to move vertically, and the sewing needle 8 of the selected needle bar and the thread-loop taker cooperate to form embroidery stitches using a selected color thread. An upper shaft, which vertically moves the needle bar and the thread take-up lever 9, and a lower shaft, which rotates the thread-loop taker, are driven by a drive shaft 18. The drive shaft 18 is driven by a main motor via a V belt 17.

A work table 13 is provided on the front side of the support plate 2 so as to be vertically movable up to the upper surface of the cylinder bed 6. A movable frame 16, extending in the X direction, is placed over a pair of side tables provided on both sides of the work table 13. A drive frame portion 16*a* at the right end of the movable frame 16 is moved in the X direction by an X-direction drive mechanism (not shown), while a drive frame portion 16*b* at the left end of the movable frame 16 is moved in the Y-direction by a Y-direction drive mechanism (not shown). Accordingly, the movable frame 16 is moved over the tables 13–15, independently, in the X and Y directions by the X- and Y-direction drive mechanisms.

A cap holding device 20 attached to each of the embroidery machines M1–M3 will now be described. The cap holding device 20 is specially designed to allow each of the embroidery machines M1–M3 to form embroidery stitches on the front and the right and left sides of a cap 200.

As shown in FIGS. 2 through 5, the cap holding device 20 includes a guide shaft 21 extending in the Y direction, a base frame 30 attached to the guide shaft 21 so as to be movable in the Y direction, a rotation preventive mechanism 24 (FIG. 5) that prevents the base frame 30 (FIGS. 4 and 5) from rotating about the guide shaft 21, a rotary frame 40 attached to the base frame 30 so as to be rotatable about an axis of the guide shaft 21, and a cap holder 80 detachably attached to the rotary frame 40. A cap has been previously set to the cap holder 80 at a preparatory station. The cap holding device 20 further includes a converting mechanism 50 that rotates the rotary frame 40 and the cap holder 80, a Y-direction feed member 28 disposed on the underside of an X-direction frame portion 16*c* at the rear end of the movable frame 16 so as to be moved only in the Y direction by the Y-direction drive mechanism, and a connecting mechanism 60 connected to the base frame 30.

The guide shaft 21 is detachably inserted rearwardly into an insertion hole 22, which is formed in the main bed 5 at a position near the base end of the cylinder bed 6, and extends horizontally in the Y direction. A fastener 23 is provided to fasten the guide shaft 21 to the main bed 5. By unfastening the fastener 23, the guide shaft 21 can be released from the insertion hole 22. A bearing portion 31 is formed at a lower part of the base frame 30 so as to be fitted around the guide shaft 21 and slidable along the guide shaft 21. Also formed in the base frame 30 is a combination of three arms 30*a*, 30*a*, 30*b* having a Y-shape in a front view. A pair of rollers 32, 33 are provided at the upper end of each of the upper arms 30*a* so as to support the rotary frame 40 internally and externally while allowing it to rotate about the axis of the guide shaft 21. An eccentric mechanism is provided for adjusting the position of each outer roller 33, in a radial direction of the rotary frame 40, relative to the corresponding inner roller 32. Two clamp members 34 having a generally L-shape in a side view are fixed to the two upper arms 30*a*, respectively, via shaft members of the rollers 32, 33.

The rotation preventive mechanism 24 will now be described. A key member 25 is fixed to the lower surface of the cylinder bed 6 and extends in the Y direction. A grooved member 26 is fixed to the base frame 30 so as to slidably engage the key member 25. This engagement prevents the base frame 30 from rotating about an axis parallel to the Y direction and allows the base frame 30 to slide only in the Y direction along the guide shaft 21.

The rotary frame 40 will now be described. The rotary frame 40 includes an annular portion 41 having a circular cross-section, and a cap holder support portion 42 having a semi-circular cross-section and extending frontward from the upper half of the annular portion 41. The annular portion 41 has an outer peripheral portion formed with a roller groove 43 and a wire guide groove 44. The outer rollers 33 provided at the base frame 30 are rotatably fitted in the roller groove 43. A wire 53 of the converting mechanism 50 is guided in the wire guide groove 44.

The lowermost portion of the annular portion 41 is slidably guided by a guide portion 35 provided at the lower end of the lower arm 30*b*. Four engagement rollers 45 are attached to the outer periphery of the annular portion 41 and are urged by spring members to hold the cap holder 80. These engagement rollers 45 are detachably engaged in engagement holes formed in the cap holder 80 when the cap holder 80 is mounted over the cap holder support portion 42.

The converting mechanism 50 will now be described. The converting mechanism 50 includes a pair of right and left end plates 51 fixed, in a spaced relationship to each other, to the upper surface of the X-direction frame portion 16*c* at the rear end of the movable frame 16, and a connecting rod 52 for connecting both of the end plates 51, and a wire 53. Each of the end plates 51 is fixed to the X-direction frame portion 16*c* with two screws 54 and one screwed knob 55. The wire 53 is connected at its left end, to a metal member 56 fixed to the left end plate 51, is wound one full turn counterclockwise along the wire guide groove 44 of the rotary frame 40, and is connected, at its right end, to a metal member 56 fixed to the right end plate 51. Alternatively, the wire 53 may be fixed, at its intermediate portion, to a lower portion of the rotary frame 40.

When the X-direction frame portion 16*c* of the movable frame 16 is moved leftward, the rotary frame 40 is rotated counterclockwise about 140 degrees from its neutral position about an axis of the annular portion 41. Meanwhile, when the X-direction frame portion 16*c* of the movable frame 16 is moved rightward, the rotary frame 40 is rotated clockwise about 140 degrees from its neutral position about the axis of the annular portion 41. The rotation angle of the rotary frame 40 is proportional to the rightward/leftward travel of the X-direction frame portion 16*c*.

Figure 3:
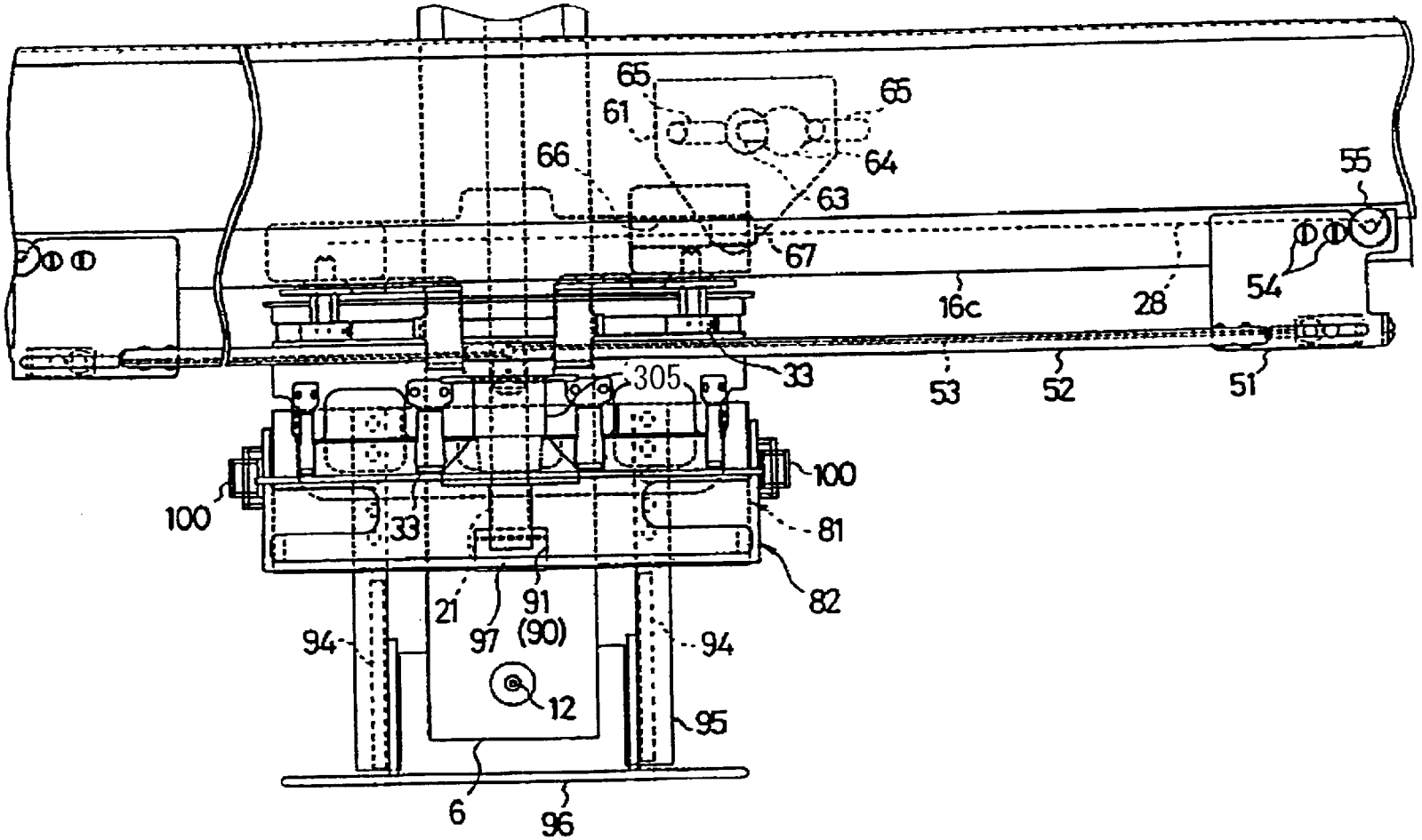
FIG. 3 is a plan view of the cap holding device of FIG. 2.
Figure 4:
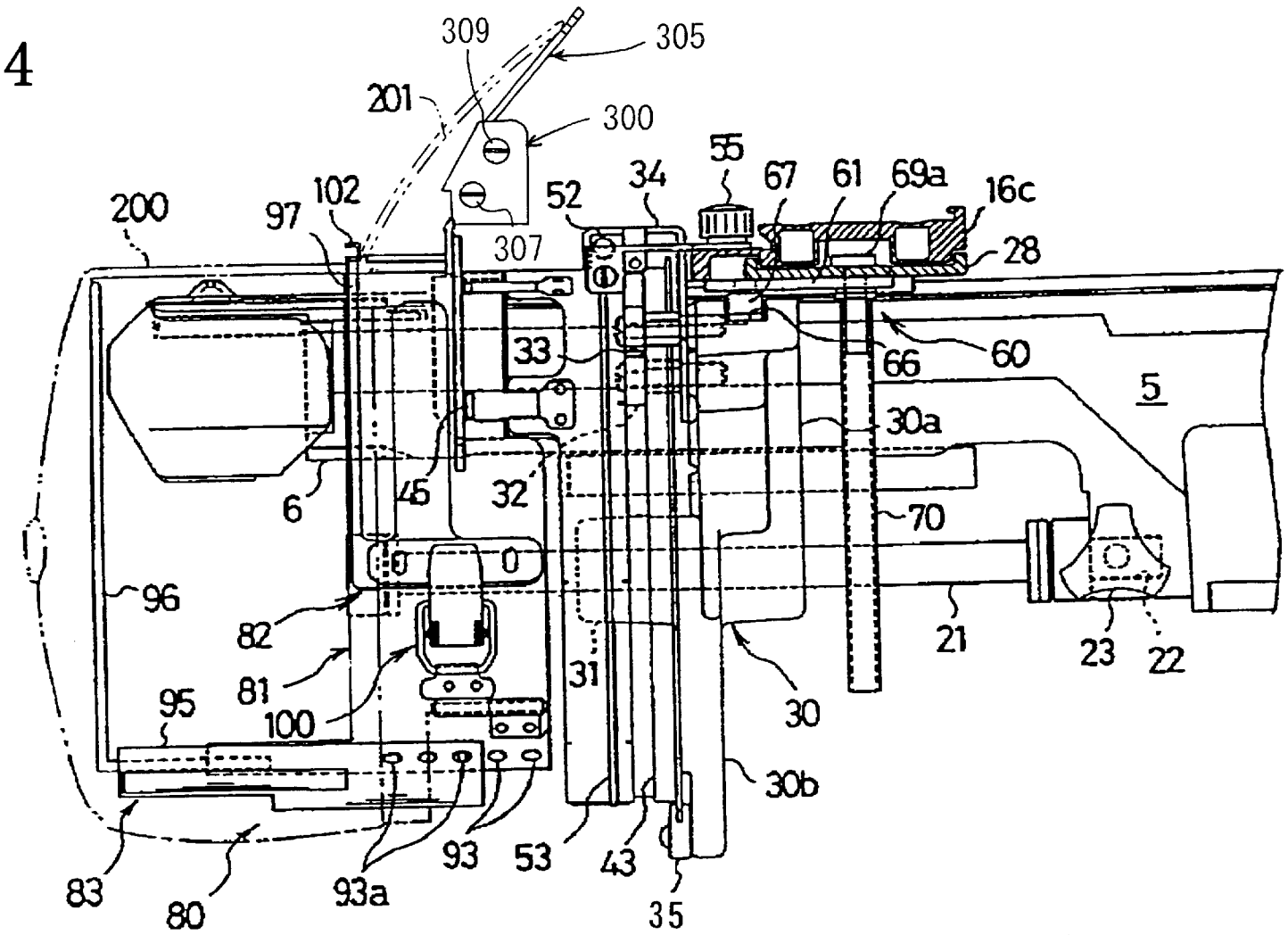
FIG. 4 is a side view of the cap holding device of FIG. 2.
Figure 5:
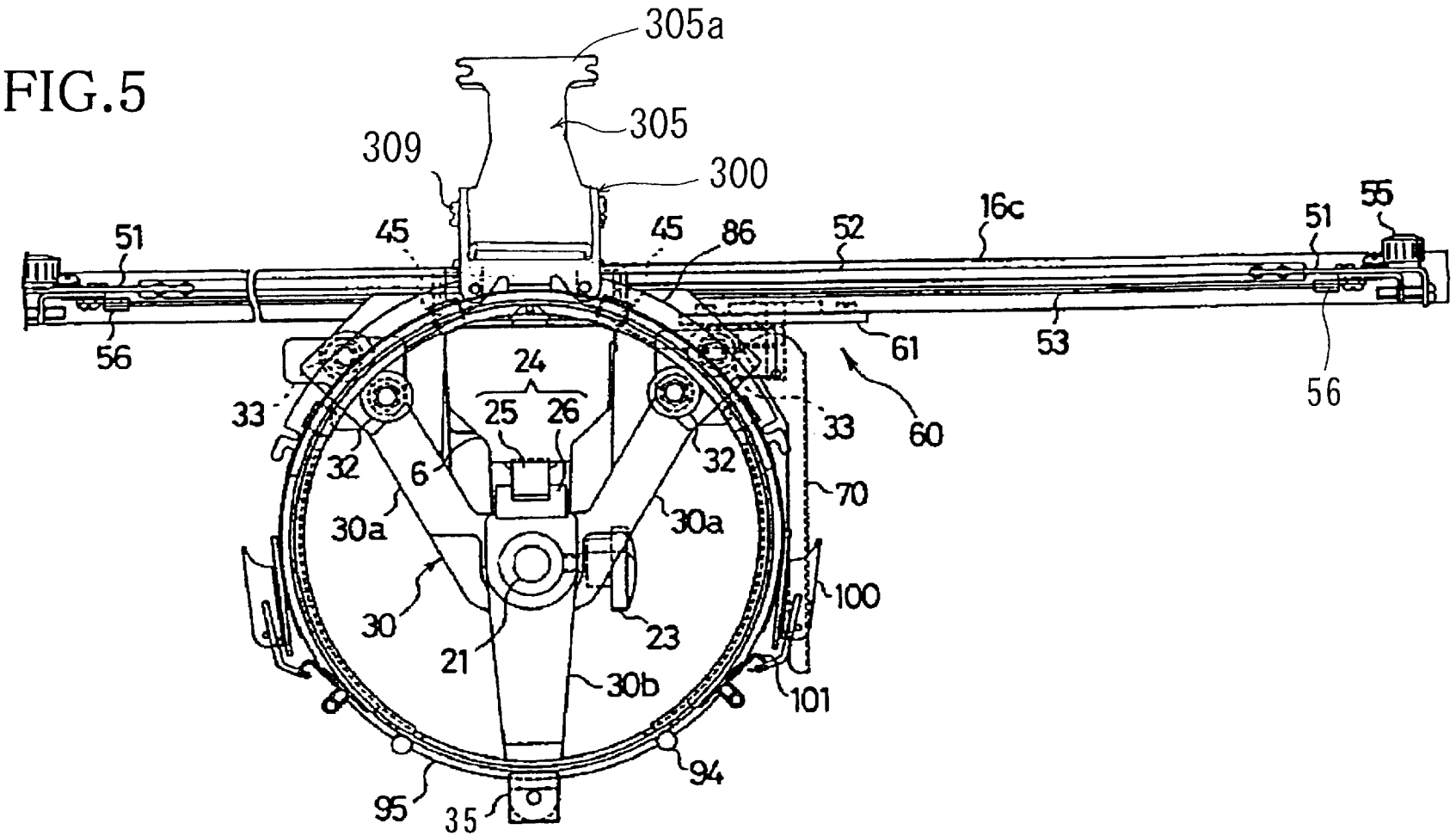
FIG. 5 is a front view of the cap holding device of FIG. 2.
Figure 6:
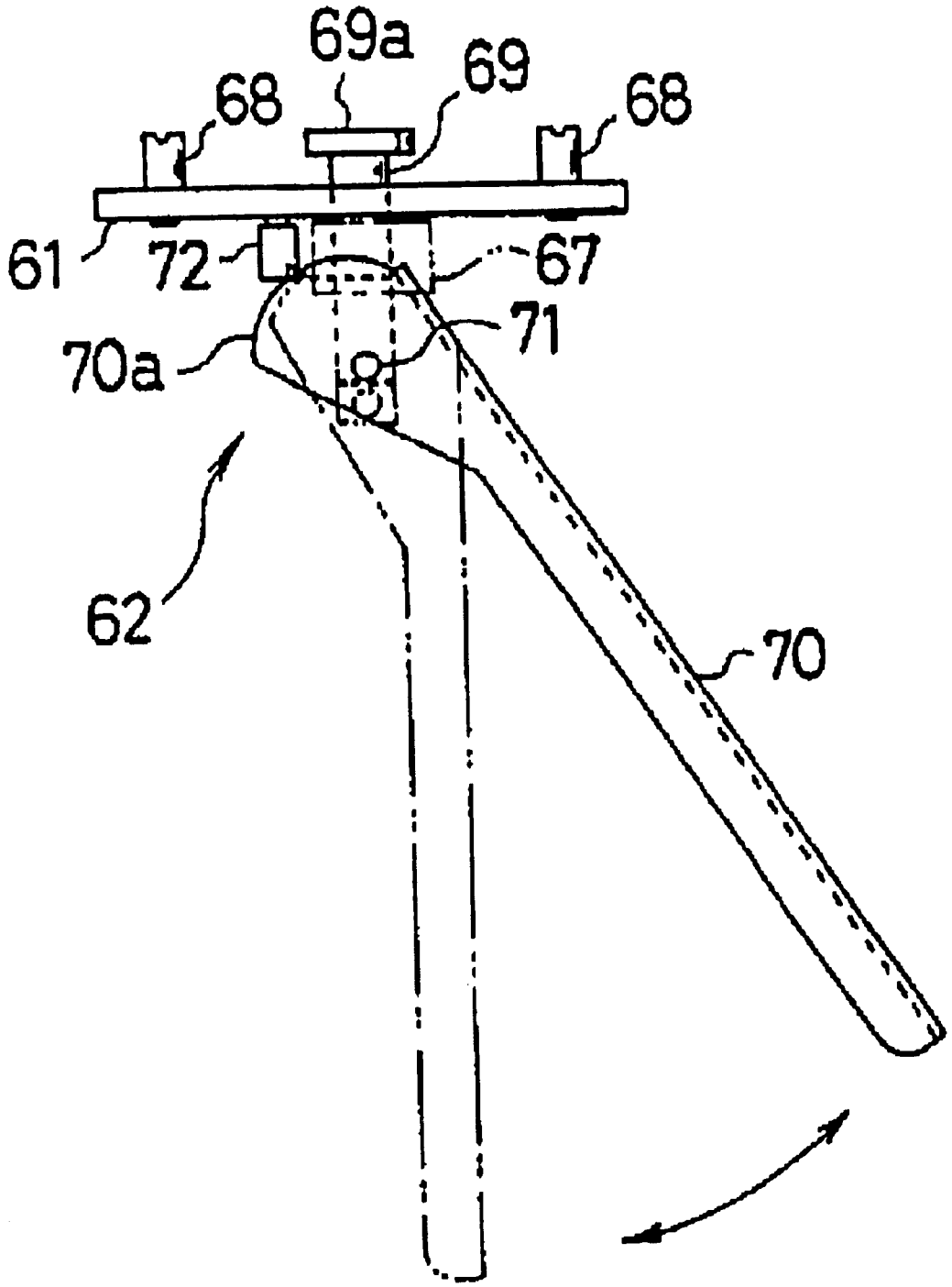
FIG. 6 is a front view of a connecting member and a clamp of the cap holding device.

The connecting mechanism 60 will now be described. As shown in FIGS. 3, 4, and 6, the connecting mechanism 60 includes a connecting member 61 that connects the Y-direction feed member 28 to the base frame 30, and a clamp 62 disposed adjacent the connecting member 61 so as to releasably clamp the connecting member 61 to the Y-direction feed member 28. As shown in FIG. 3, the Y-direction feed member 28 has a circular hole 64 with a slot 63, and a pair of slits 65 extending in the X direction. An engagement member 67 is fixed to the lower surface of the front end of the connecting member 61 so as to engage the engagement groove 66 extending in the X direction at the upper end of the right arm 30*a*. A pair of positioning pins 68 are vertically provided on the upper surface of the connecting member 61 so as to engage the pair of slits 65.

The connecting member 61 is clamped to the Y-direction feed member 28 by vertical movements of a flanged shaft 69 of the clamp 62. The flanged shaft 69 is inserted into the connecting member 61. A flange portion 69*a* of the flanged shaft 69 is of the size to be insertable into the circular hole 64. An operating lever 70 is connected to a lower end portion of the flanged shaft 69 via a pin 71. A curved portion 70*a* of the operating lever 70 is received by a receiving member 72 fixed to the connecting member 61. By moving the operating lever 70 to a position shown by the solid line, the flanged shaft 69 is brought into a position released from the connecting member 61. On the other hand, by moving the operating lever 70 to a position shown by the dotted line, the flanged shaft 69 is brought into a position clamped to the connecting member 61.

The connecting member 61 is clamped to the Y-direction feed member 28 as follows. The flange portion 69*a* is inserted into the circular hole 64 with the flanged shaft 69 kept in the released position, and the positioning pins 68 are fitted into the slits 65. In this state, the connecting member 61 is moved leftward through relative movements of an engagement groove 66 and the engagement member 67 until a shaft portion of the flanged shaft 69 engages the slot 63. Then, the operating lever 70 is operated to shift the flanged shaft 69 to the clamped position. As a result, the connecting member 61 is clamped to the Y-direction feed member 28 by the flange portion 69*a*.

The cap holder 80 will now be described. As shown in FIGS. 2 through 9 and 11 through 16, the cap holder 80 includes a main holder body 81, a presser frame member 82, and a shape-keeping member 83. The main holder body 81 has a generally circular shape and is detachably attached over the rotary frame 40. The presser frame member 82 is detachably fixed over the main holder body 81 with the cap 200 sandwiched therebetween. The main holder body 81 includes a mounting frame 84 having about a 360-degree circular cross section and attached over the rotary frame 40, a cap mount 85 extending frontward by a predetermined distance from the front end of the mounting frame 84, a flanged portion 86 disposed around the mounting frame 84, and a fixed member 300 fixed to the flanged portion 86 and projecting rearward, at an angle, from an uppermost central portion of the mounting frame 84.

The fixed member 300 is provided with a pair of mounting plates 301 (FIG. 16), each having a circular hole 302 and an arcuate slot 303 extending about an axis of the circular hole 302. In addition, a receiving member 304 (FIG. 9) is formed at the front face of the fixed member 300 so as to receive, from the rear, an inner central portion of the base end of a visor 201 of the cap 200.

Inner walls of the mounting plates 301 of the fixed member 300 are opposed to a pair of folded plates 306 of a visor support 305, which supports the visor 201 of the cap 200. A screw portion of a stepped screw 307 is inserted into each circular hole 302 and is screwed into a screw hole 308 formed in each of the folded plates 306 such that the visor support 305 is pivotably mounted to the mounting plates 301 of the fixed member 300.

Additionally, a screw portion of a screw 309 is inserted into each slot 303 and is screwed into a screw hole 310 formed in each of the folded plates 306. By loosening the screws 309 and by pivoting the visor support 305 about the stepped screws 307, the angle of inclination of the visor support 305 can be adjusted. As a result, the bending angle of the cap 200 is adjusted. Such adjustment allows the visor support 305 to support the visor 201 of the cap 200 at an angle with respect to the horizontal axis. By selecting the angle of inclination of the visor support 305 appropriately, depending on the sizes of the cap 200 and the visor 201, problems associated with a conventional embroidery machine can be prevented. Specifically, the above-described visor support 305 can prevent, when the cap holder is moved, contact and friction between the visor 201 of the cap 200 set in the cap holder 80 and the arm 3 of the embroidery machine, which cause a partially shiny, shabby appearance of the visor 201 or damage to the visor 201, and prevent deformation of the visor 201, which reduces the commercial value of the cap 200. In addition, a pair of right and left notches 305*b* are formed at upper end portions 305*a* of the visor support 305. An elastic cord 89 (FIG. 7) is passed through the notches 305*b* so as to urge the visor 201 of the cap 200 rearward, and is detachably fitted, at its right and left ends, into notches in the flanged portion 86.

Figure 2:
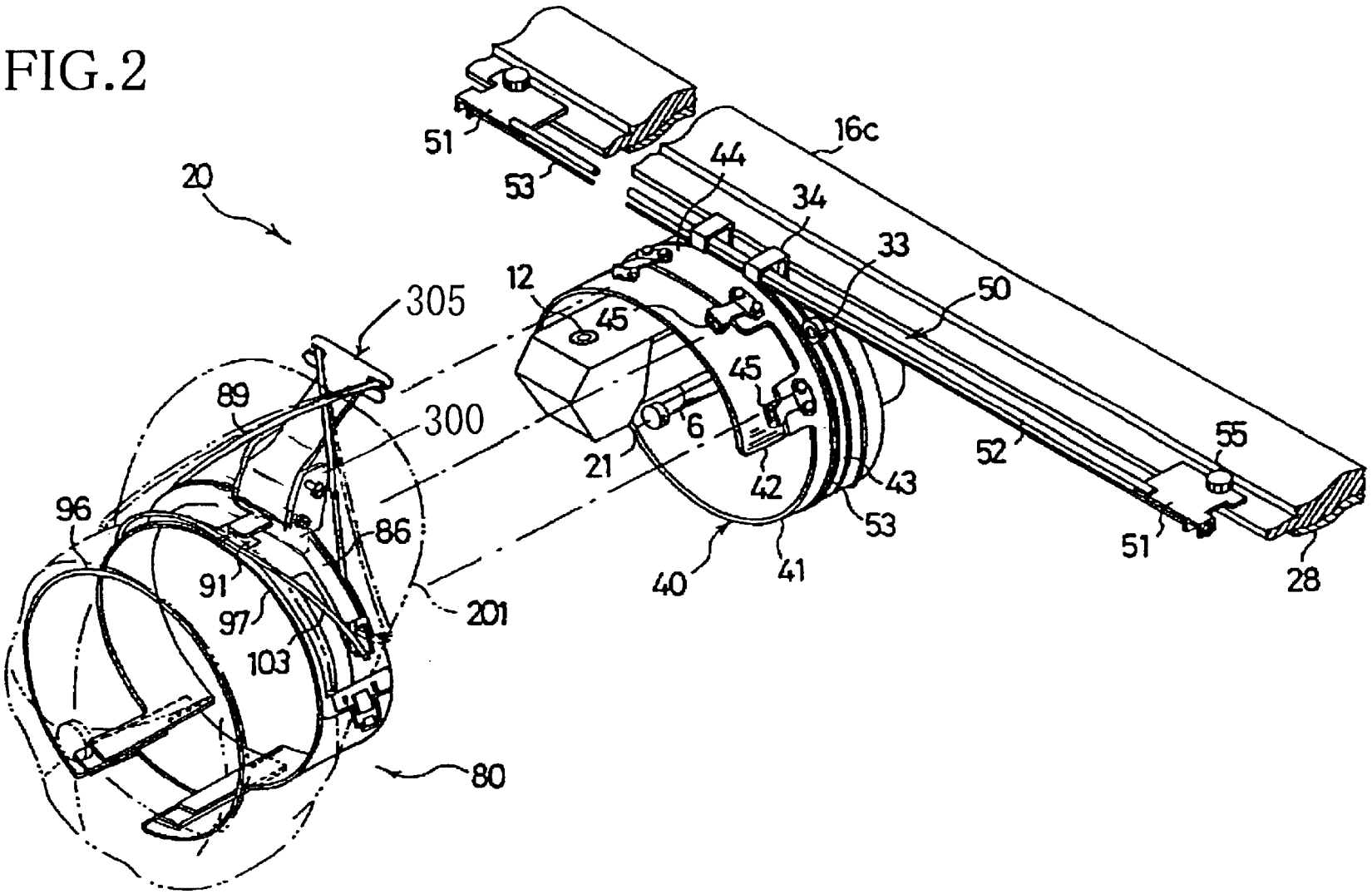
FIG. 2 is a perspective view of a cap holding device mounted on the multiple-head embroidery machine of FIG. 1, where a cap holder is detached from the cap holding device.
Figure 7:
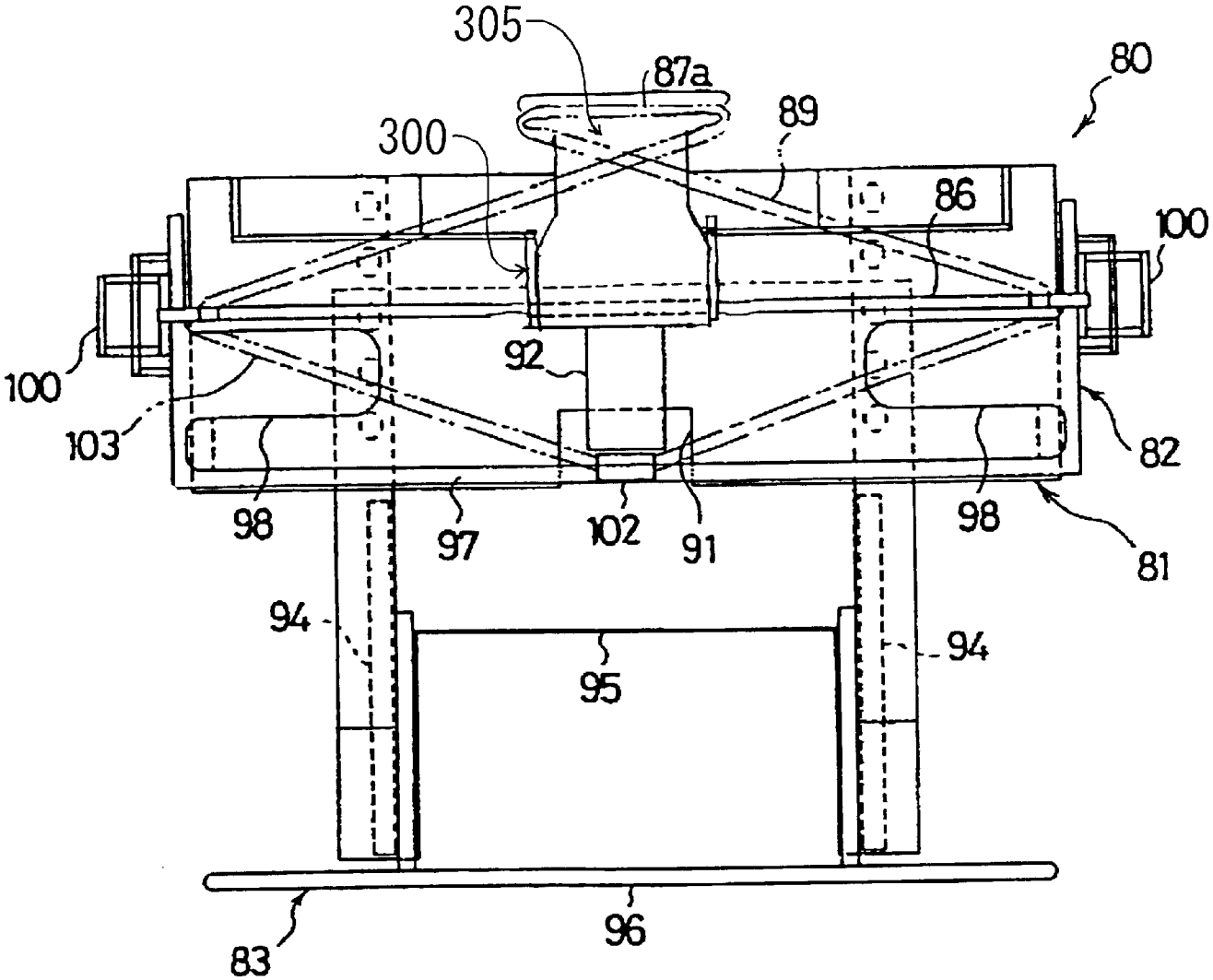
FIG. 7 is a plan view of the cap holder of the cap holding device.
Figure 8:
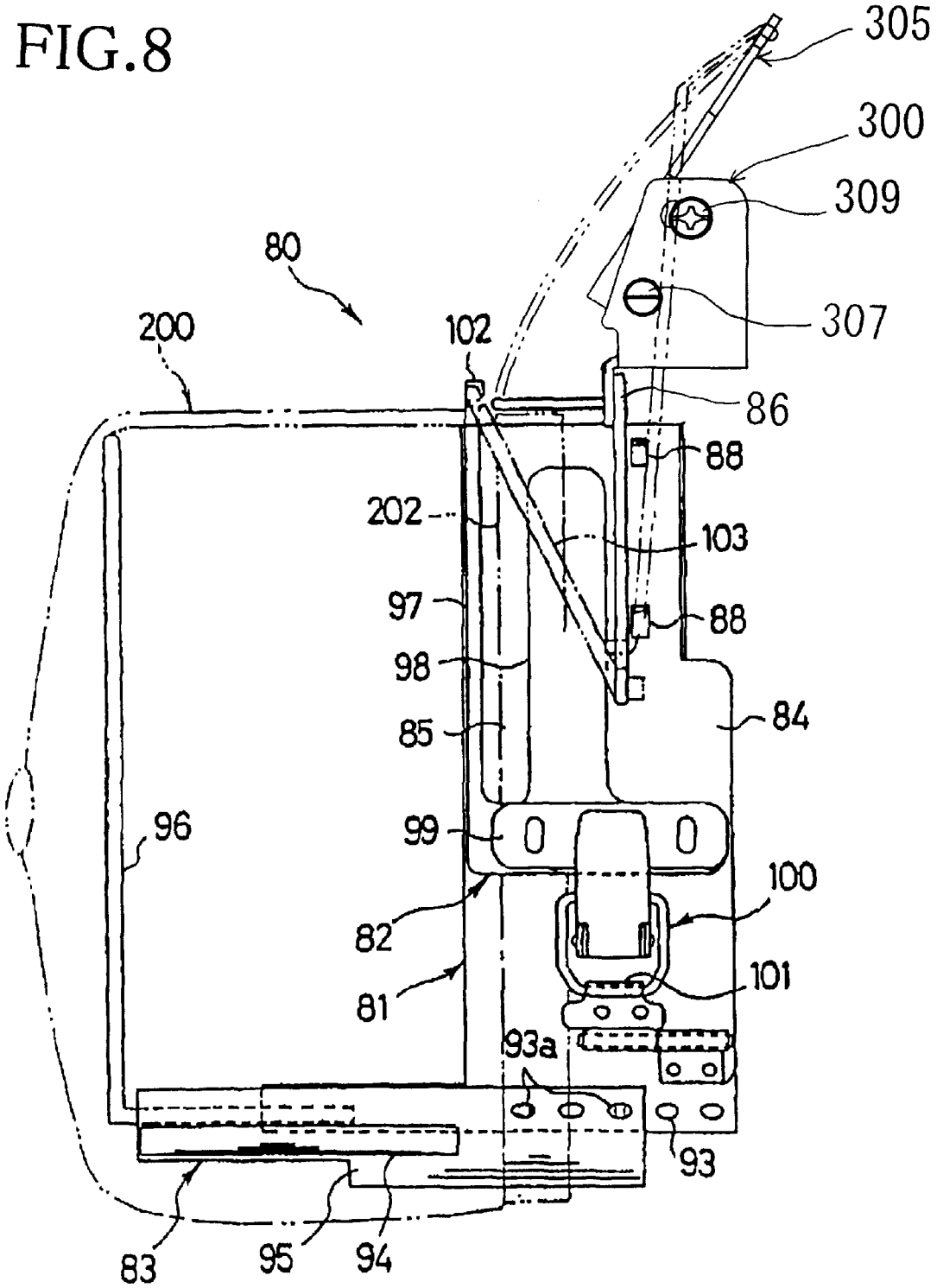
FIG. 8 is a side view of the cap holder of the cap holding device.

The mounting frame 84 has four engagement holes 88 with which the four respective engagement rollers 45 are engaged. By the engagement of the engagement rollers 45 with the engagement holes 88, the cap holder 80 is detachably fixed to the rotary frame 40. As shown in FIGS. 2 and 7, a cutout 91 is formed at an uppermost central portion of the cap mount 85 of the main holder body 81 so as to be open toward the front end of the cap mount 85. A fabric of the cap 200 can be released downward into the cutout 91.

A shape-keeping member 83, which stretches the cap 200 while keeping the shape of the cap 200 (especially the shapes of the front and the right and left sides of the cap 200) curved without any slack, is fixed to the lower ends of the main holder body 81 using screw holes 93 and screws 93*a*. The position of the shape-keeping member 83 relative to the main holder body 81 can be changed by selecting the screw holes 93 to be used. The shape-keeping member 83 includes a bridge member 95, an arcuate member 96, and a pair of clipping rods 94. The bridge member 95 is a curved plate fixed with the screws 93*a* to the main holder body 81 and bridges the lower ends of the holder body 81. The arcuate member 96 extends upward from the front ends of the bridge member 596 and has about a 300-degree arcuate cross-section. The right and left clipping rods 94 are secured to the underside of the bridge member 95.

The presser frame member 82 will now be described. As shown in FIGS. 2 through 8, the presser frame member 82 is flexible and detachably attached over the cap mount 85 of the main holder body 81 with the cap 200 sandwiched therebetween. The presser frame member 82 includes a presser frame portion 97, a pair of presser strips 98, a pair of connectors 99, and a pair of connecting metal members 100 attached to the connectors 99. The presser frame portion 97 is narrow in width and is curved along and beyond the vicinity of the base end of the visor 201 so as to externally press the front half of the cap 200. The right and left presser strips 98 press a sweatband 202, which is folded outward from the cap 200. The connectors 99 have the same width as the front-to-rear width of the main holder body 81. Each of the connectors 99 is provided with a connecting metal member 100, which is releasably engaged with a hook 101 provided on the cap mount 85 of the main holder body 81.

In order to prevent the presser frame portion 97 from being displaced frontward from the vicinity of the base end of the visor 201, a hook 102 (FIGS. 7 and 8), having a generally U-shaped cross-section, is formed at an uppermost central portion of the presser frame portion 97. An elastic cord 103 is passed through the hook 102 and is detachably fitted, at its right and left ends, into the notches of the flanged portion 86. The hook 102 and the elastic cord 103 cooperate to urge the presser frame portion 97 rearward.

The effects of the cap holder 80 of the cap holding device 20 will now be described. A cap 200 is set on the cap holder 80 at an external preparatory station. In this case, when the main holder body 81 is fixedly supported by an external cap holder setting frame, the cap 200 is fitted over the main holder body 81, from the front thereof, with the sweatband 202 folded outward. Then, the presser frame member 82 is fitted over the cap mount 85 so as to sandwich the cap 20 therebetween. In this state, the position and shape of the cap 200 should be adjusted. Also, the positions of the presser frame portion 97 and the presser strips 98 should be adjusted as required. After that, the connecting metal members 100 on both sides of the presser frame member 82 are engaged with the respective engagement hooks 101. At this time, the fabric of the cap 200 is kept stretched, at its front and its left and right sides, aided by an arcuate member 96 of the shape-keeping member 83.

Figure 9:
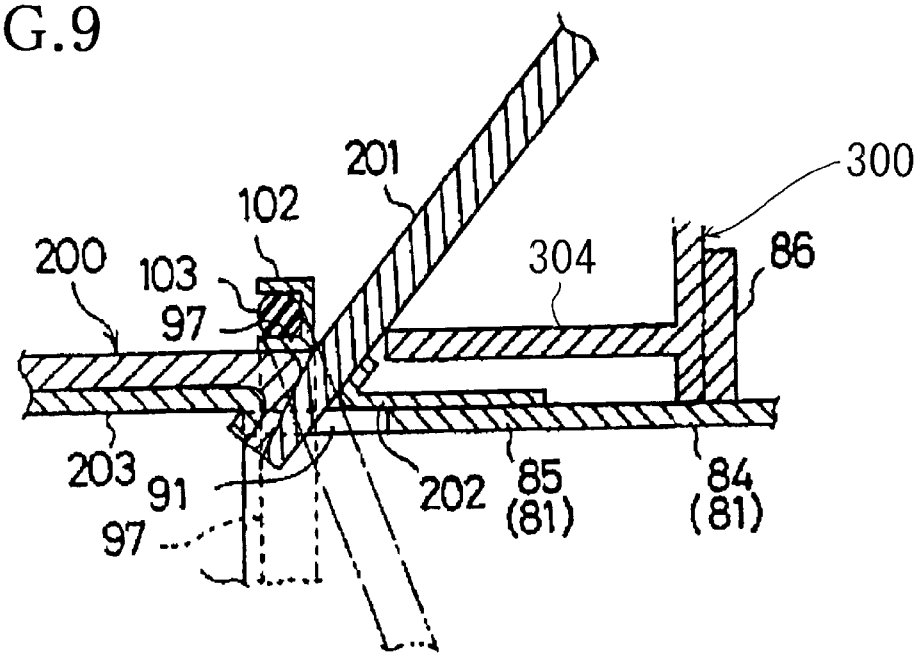
FIG. 9 is a vertical cross-sectional side view of essential portions, such as a cutout and a cap fabric.

As shown in FIG. 9, because the presser frame portion 97 is urged toward the visor 201 (rearward) by the elastic cord 103, the presser frame portion 97 is kept in position in the vicinity of the base end of the visor 201 without becoming detached from the front end of the main holder body 81 even when the fabric of the cap 200 is pulled frontward by the shape-keeping member 83. In addition, because the visor 201 is received, at its base end, by the receiving member 304, the uppermost central portion of the base end of the visor 201 is kept in position even when the presser frame portion 97 is urged rearward by the elastic cord 103. Thus, the presser frame portion 97 is not displaced rearward, either.

Figure 10:
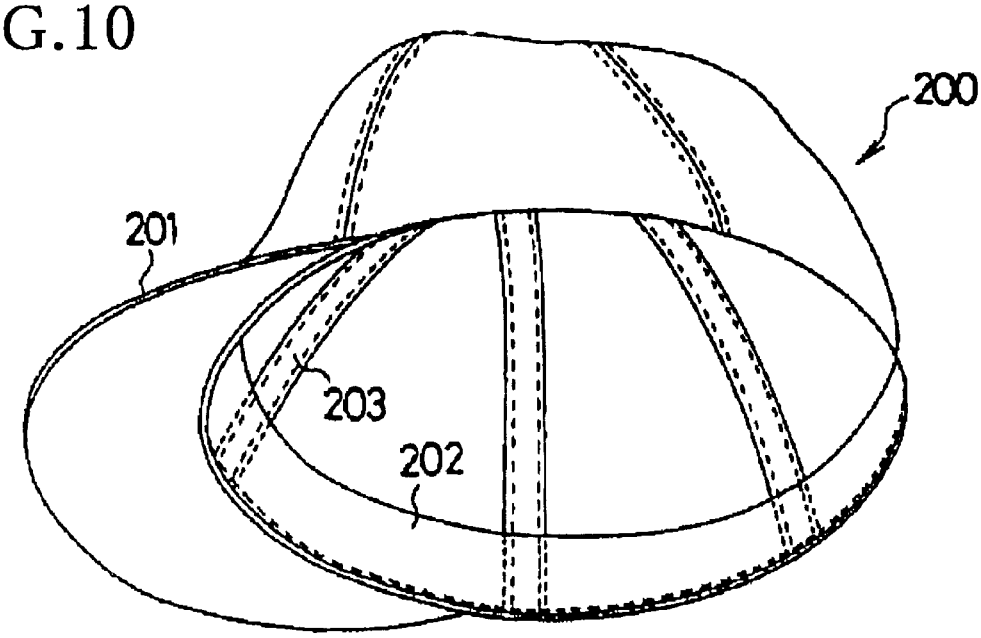
FIG. 10 is a perspective view of a cap.
Figure 11:
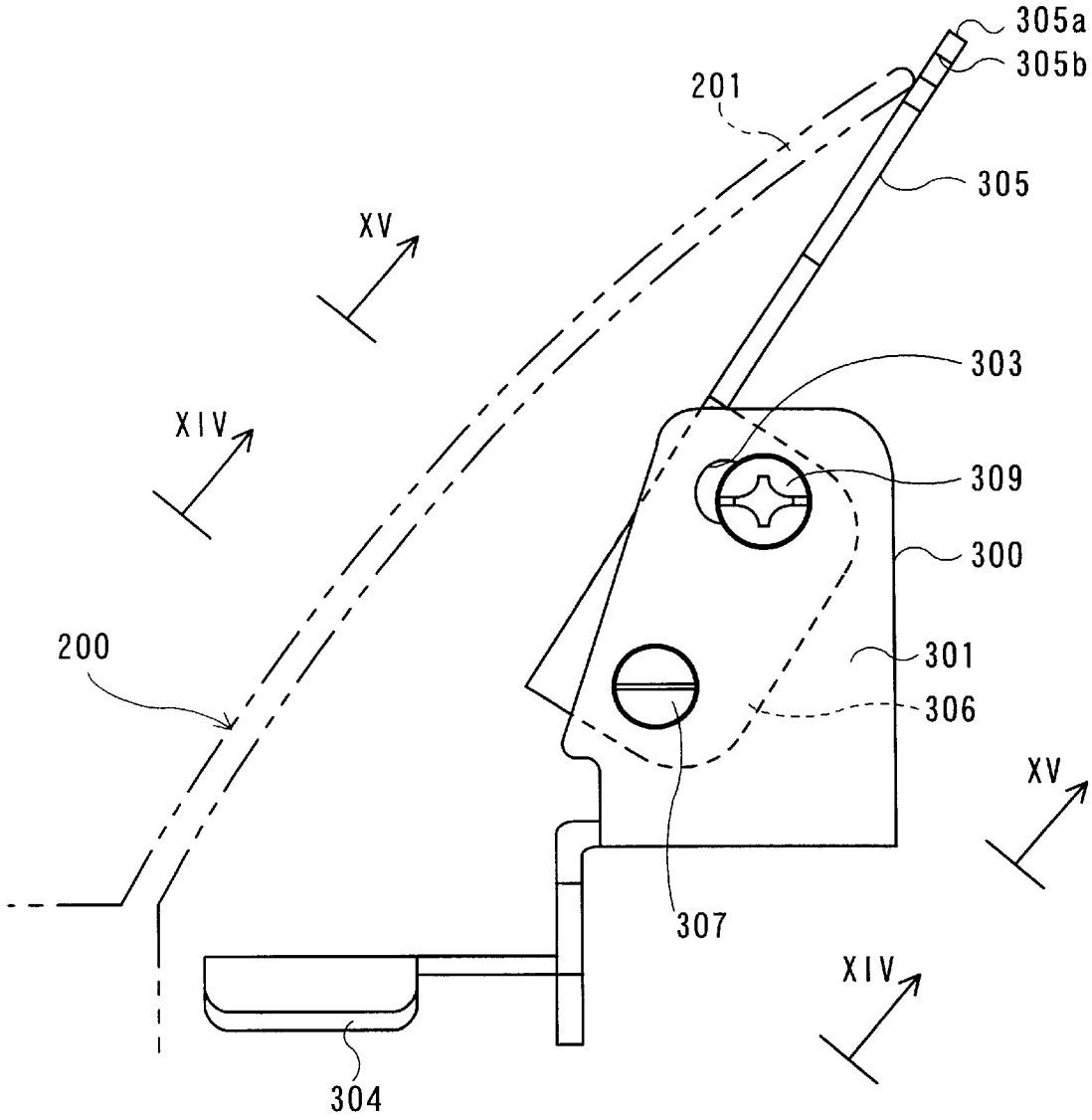
FIG. 11 is a side view showing the positional relationship between a fixed member and a visor support.
Figure 12:
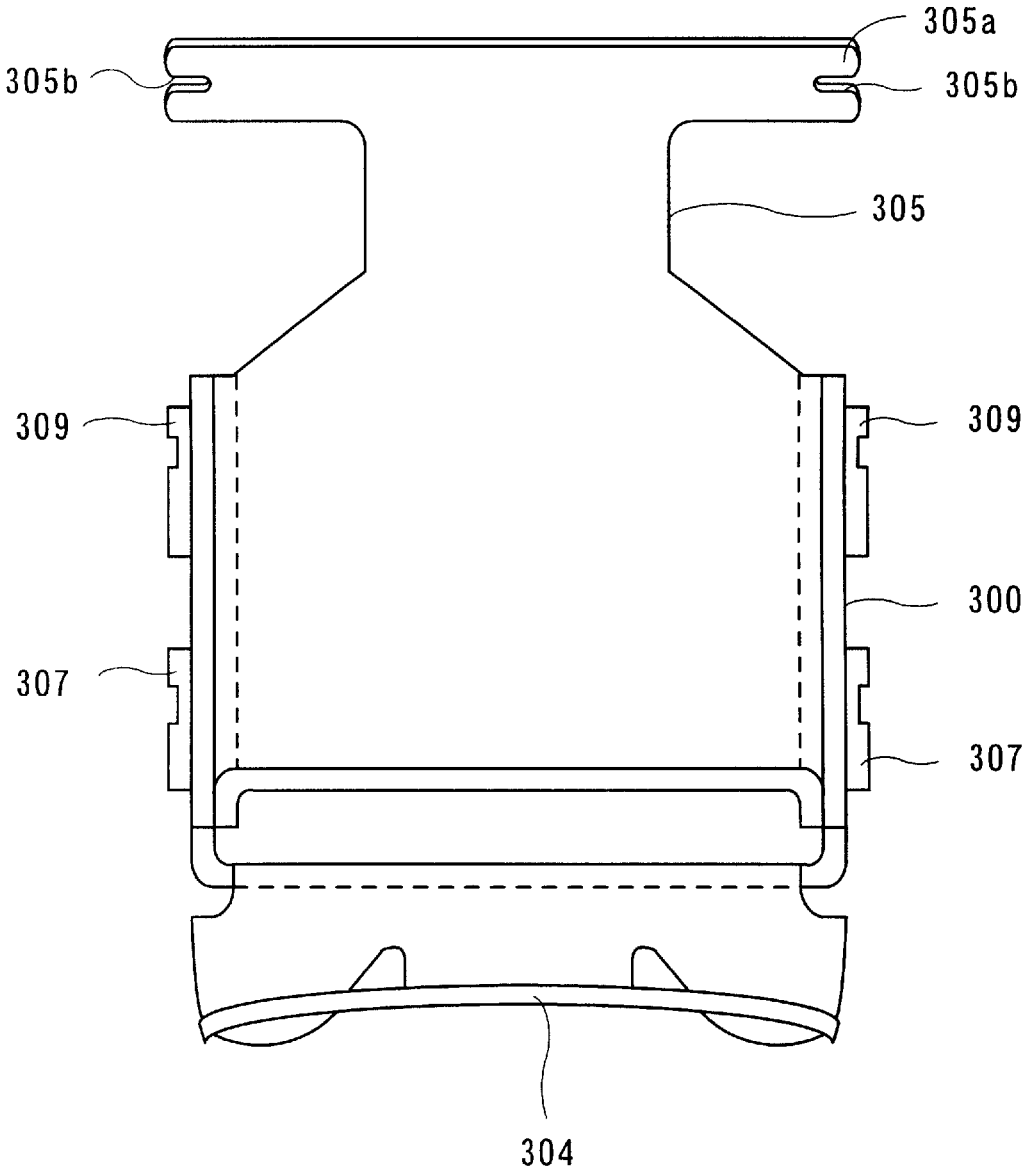
FIG. 12 is a front view showing the positional relationship between the fixed member and the visor support.
Figure 13:
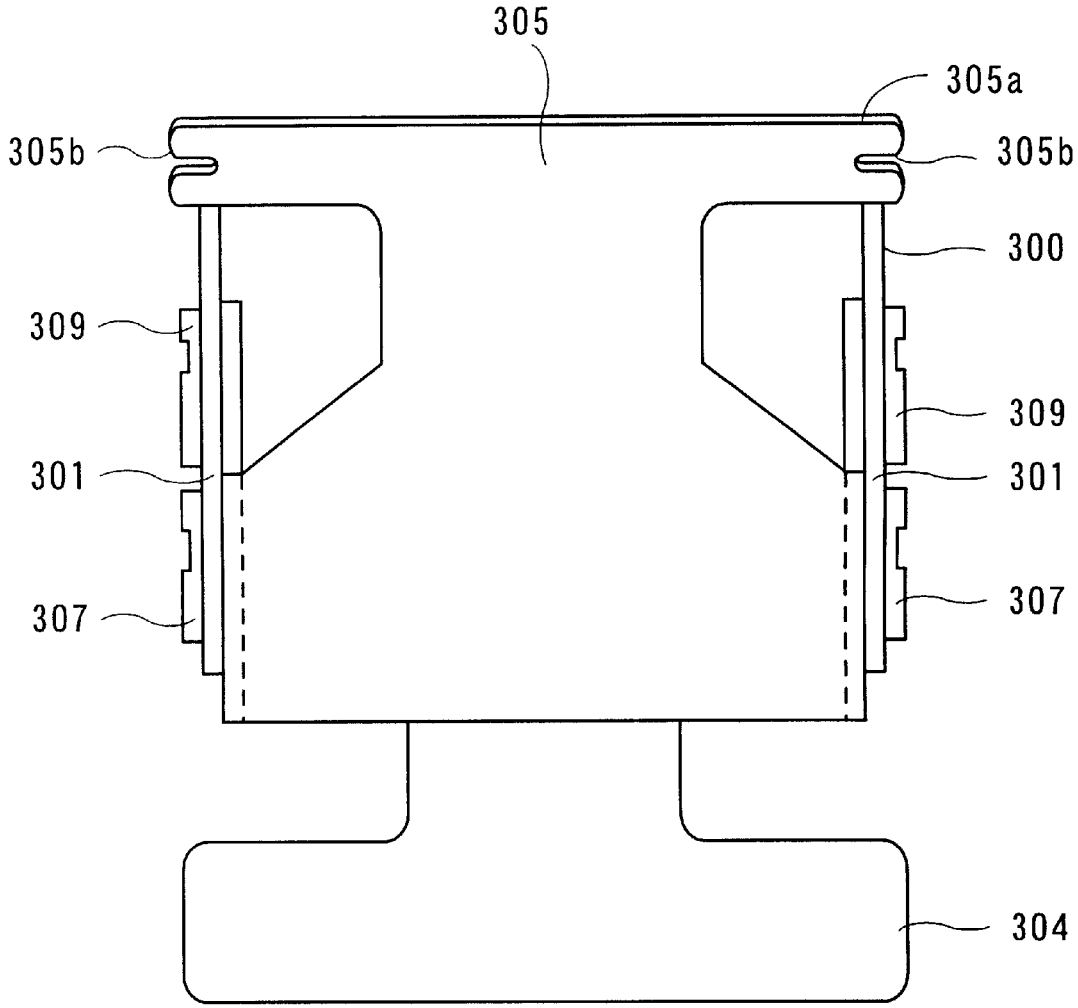
FIG. 13 is a plan view showing the positional relationship between the fixed member and the visor support.
Figure 14:
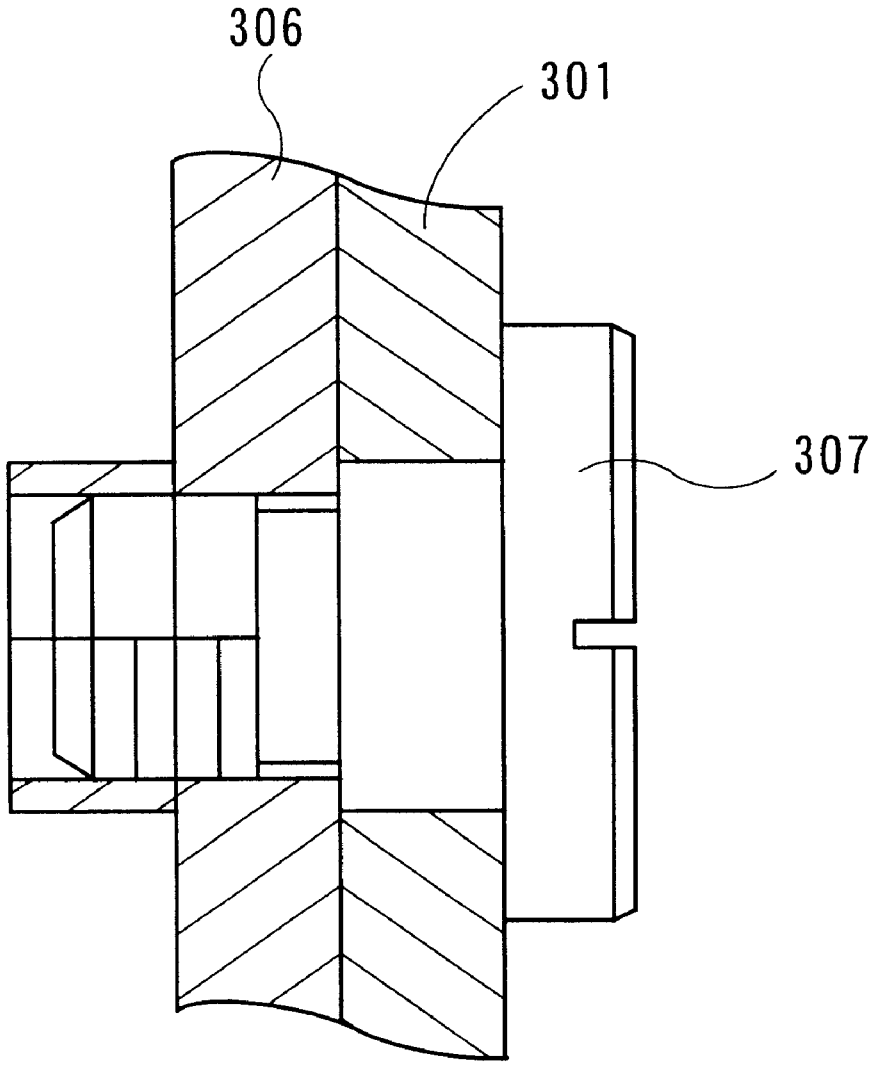
FIG. 14 is a cross-sectional view taken along the line XIV—XIV of FIG. 11.
Figure 15:
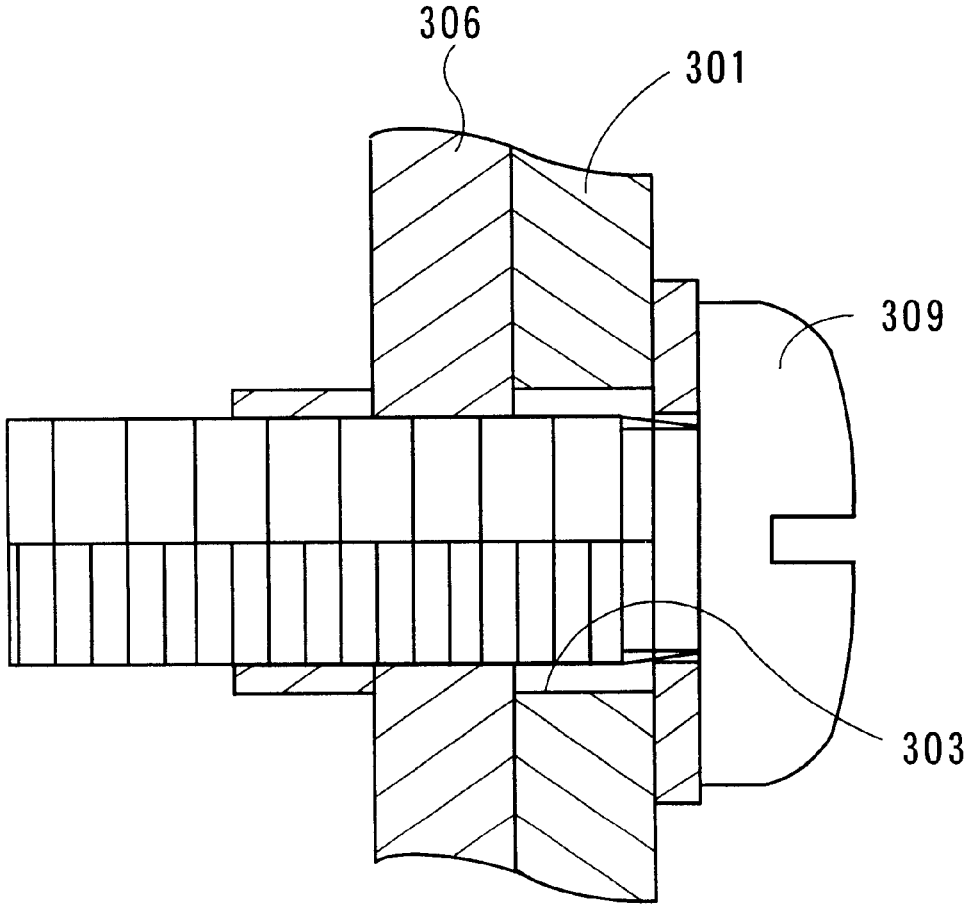
FIG. 15 is a cross-sectional view taken along the line XV—XV of FIG. 11.
Figure 16:
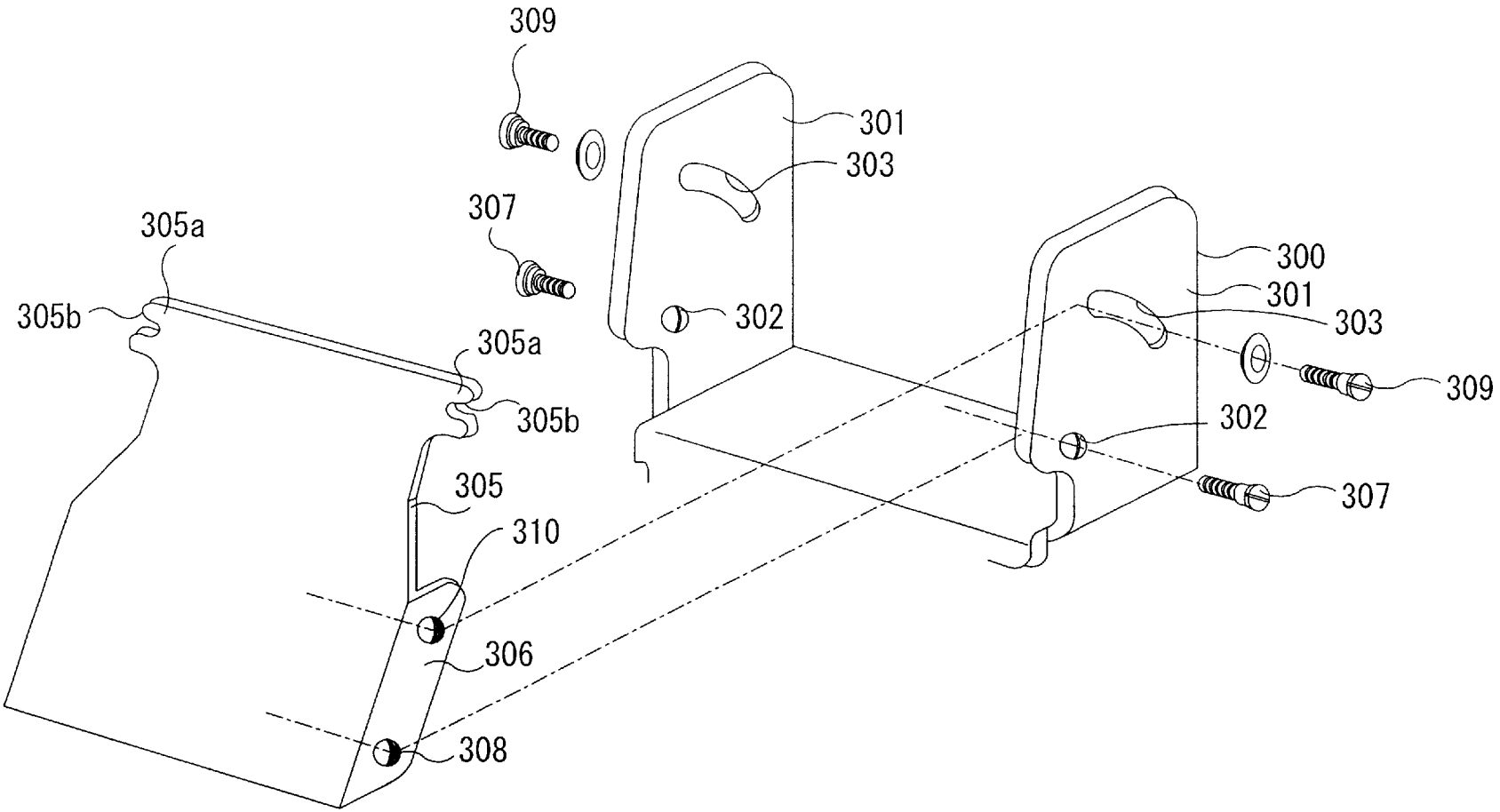
FIG. 16 is an exploded perspective view showing the positional relationship between the fixed member and the visor support.
Figure 17:
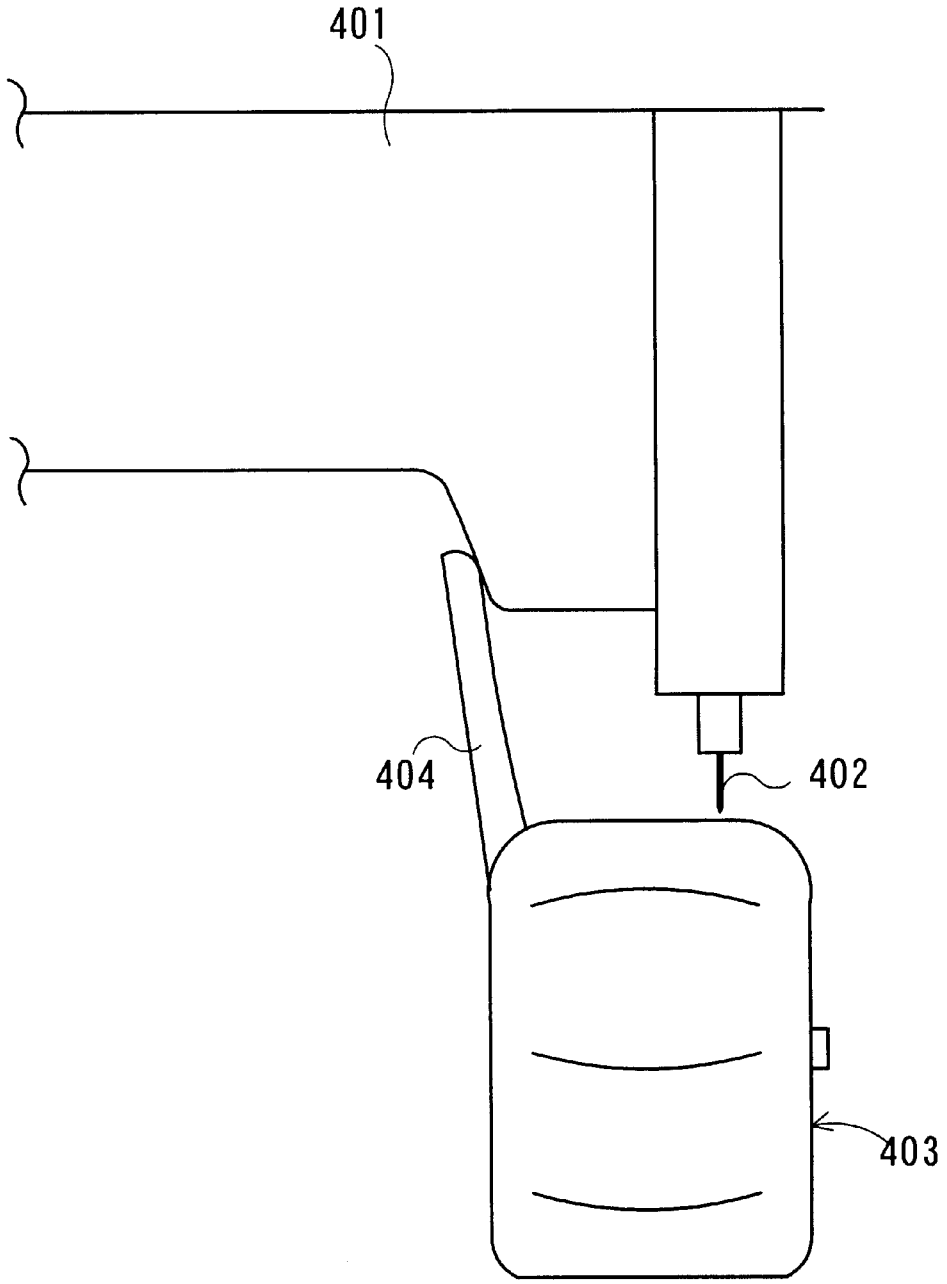
FIG. 17 illustrates a cap set in a conventional cap holding device.
Figure 18:
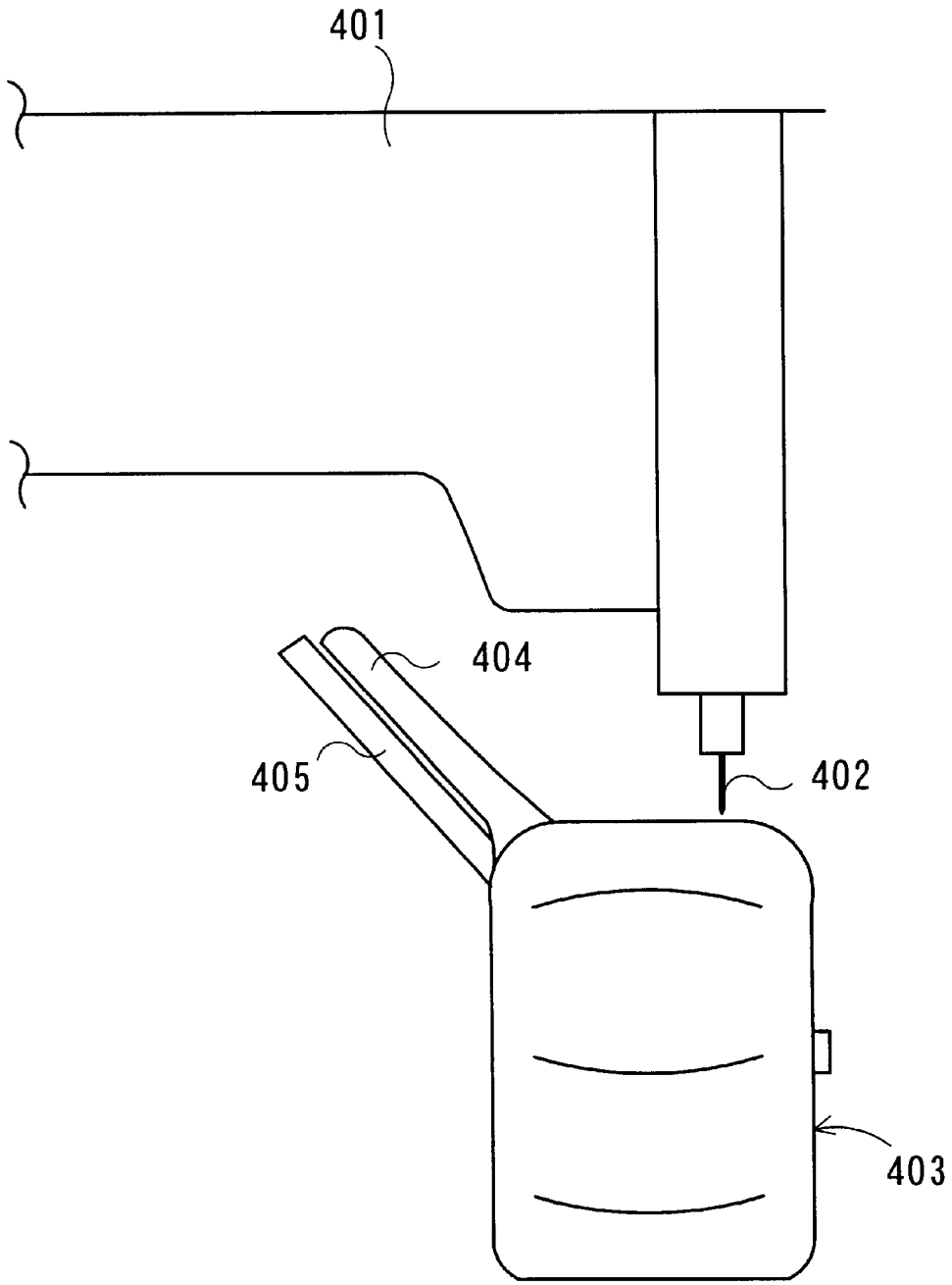
FIG. 18 illustrates a cap set in another conventional cap holding device.

Further, because the base end of the visor 201 can be released into the cutout 91, a thick fabric portion will not project outward. Especially when stitches are formed at a front central portion of the cap 200, as shown in FIG. 10, a thick fabric portion, where the front central stitches overlap the stitches formed at the base end of the visor 201 and a reinforcing fabric 203, can be released into the cutout 91. Thus, the thick fabric portion will not project outward.

The cap holder 80, specially designed as described above, ensures improvements in workability and work efficiency when the cap 200 is set on the cap holder 80. The cap holder 80 with the cap 200 set thereon is detachably mounted on the rotary frame 40 of the cap holding device 20. Then, embroidery stitches are formed at the front and/or on the left and right sides of the cap 200, as required. After that, the cap holder 80 with the cap set thereon is removed from the rotary frame 40 of the cap holder 80.

During formation of the embroidery stitches, a central portion of the base end of the visor 201 is kept in position, and a thick fabric portion at the central portion of the base end of the visor 201 is released into the cutout 91 without projecting outward. Additionally, the presser frame portion 97, urged by the elastic cord 103, is kept in position and will not be displaced to the embroidery area. As a result, the embroidery area will not be reduced, or the sewing needle 8 will not be broken by the displaced presser frame portion 97.

As alternate embodiments of the invention, partial changes can be made to the foregoing embodiment.

Instead of the elastic cord 103, which urges the presser frame portion 97 toward the visor 201, elastic and flexible cord-like members, such as a small-diameter coil spring, a combination of a small-diameter wire and a spring, and a combination of a piano wire and a spring, can be used. Although the elastic cord 103 is a single cord, a plurality of cords may be used to urge one or more positions of the presser frame portion 97.

Instead of the single wire 53 used in the converting mechanism 50, a pair of left and right wires may be used to rotate the rotary frame 40.

The presser frame member 82 of the cap holder 80 may be hinged, at its one end, on the main holder body 81 and may be provided, at its other end, with a single connecting metal member 100 that is releasably engaged with a hook 101 of the main holder body 81.

It should be understood that the foregoing embodiments of the invention are intended to be illustrative, not limiting. Various modifications and alternations can be made thereto by those skilled in the art without departing from the scope of the invention as defined in the following claims.

What is claimed is:

1. A headgear holding device of a sewing machine, comprising:

a headgear holder that holds a headgear with a visor while being moved along a horizontal axis intersecting a path of a vertically moving sewing needle and rotated about the horizontal axis;

a visor support member that supports the visor of the headgear held on the headgear holder at an angle with respect to the horizontal axis; and an angle adjusting member that adjusts an angle of inclination of the visor supported by the visor support member.

2. The headgear holding device according to claim 1, wherein the angle adjusting member has a fixed member fixed to the headgear holder and a pivot member pivotably attached to the fixed member.

3. The headgear holding device according to claim 2, wherein the pivot member is pivotable about an axis perpendicular to the horizontal axis, with respect to the fixed member.

4. The headgear holding device according to claim 3, wherein the angle adjusting member includes an arcuate slot and a positioning member that positions the pivot member along the arcuate slot.

5. The headgear holding device according to claim 4, wherein the arcuate slot is formed in the fixed member, and the fixed member has a circular hole, a first screw is inserted into the circular hole, and a second screw is inserted into the arcuate slot, while the pivot member has a first screw hole to be aligned with the circular hole and a second screw hole to be aligned with the arcuate slot, the circular hole, the first and second screws, and the first and second screw holes constituting the positioning member.

6. The headgear holding device according to claim 5, wherein the pivot member has a plate-like member extending from the visor support member, the first and second screw holes being formed in the plate-like member, and the first and second screws of the fixed member being inserted respectively into the first and second screw holes formed in the plate-like member such that the plate-like member slidably pivots with respect to the fixed member.

7. A headgear holding device detachably attached to a sewing machine that sews a pattern on a headgear having a body and a visor, the headgear holding device comprising:

a body support member that is rotatable about a horizontal axis intersecting a vertical sewing needle movement and supports the body of the headgear; and a visor support member that is attached to the body support member and supports the visor of the headgear at a variable angle with respect to the horizontal axis.

8. The headgear holding device according to claim 7, wherein the visor support member includes a fixed member secured to the body support member and a pivot member pivotable with respect to the fixed member, the pivot member pivoting to change an angle of inclination of the visor of the headgear supported by the visor support member.

9. The headgear holding device according to claim 8, wherein the fixed member has an arcuate slot extending along a part of a circle, and the pivot member pivots along the arcuate slot.

10. The headgear holding device according to claim 9, wherein the fixed member has, at its lower portion, an insertion hole and a first screw is inserted into the insertion hole and has, at its upper portion, a second screw that is inserted into the arcuate slot, while the pivot member has, at its lower portion, a first screw hole to be aligned with the insertion hole and has, at its upper portion, a second screw hole to be aligned with the arcuate slot.

11. A headgear holding device of a sewing machine that sews a pattern on a headgear having a body and a visor, the headgear holding device comprising:

a rotary frame that has an annular portion and is rotatable about a horizontal axis intersecting a vertical sewing needle movement;

a headgear holder that is detachably attached to the rotary frame and holds the body of the headgear;

a visor holding member that is attached to the headgear holder and holds the visor of the headgear at a certain angle with respect to the horizontal axis; and a holding angle changing member that changes the certain angle of the visor held by the visor holding member.

12. The headgear holding device according to claim 11, wherein the holding angle changing member includes a fixed member secured to the headgear holder and a pivot member pivotably attached to the fixed member, the pivot member pivoting with respect to the fixed member to change the certain angle.

13. The headgear holding device according to claim 12, wherein the pivot member has a base portion attached to the fixed member and a sliding portion that slides with respect to the fixed member along an arc about the base portion.

14. The headgear holding device according to claim 13, wherein the base portion includes a first screw hole while the sliding portion includes a second screw hole, and the fixed member includes a circular hole to be aligned with the first screw hole, a first screw is inserted into the circular hole and engaged with the first screw hole, a slot is aligned with the second screw hole, and a second screw is inserted into the slot and engaged with the second screw hole.

15. The headgear holding device according to claim 14, wherein the slot is formed into an arc about the circular hole.

16. The headgear holding device according to claim 15, wherein the first screw is a stepped screw.

17. The headgear holding device according to claim 12, wherein the pivot member includes a pair of plate-like members extending perpendicularly from the visor holding member.

18. A visor support device, used with a cap holder having a main holder body and a presser frame member, portions of a cap body mounted between the presser frame member and the main holder body, the visor support device comprising:

a fixed member mounted to the main holder body;

a visor support privately mounted to the fixed member and capable of pivotal movement through a predetermined arc; and an elastic member extending from an end of the visor support away from the pivotal mount to attachment members provided in the main holder body.

19. The visor support device according to claim 18, wherein the fixed member comprises:

a base;

a mounting plate at each end of the base and extending at substantially a right angle to the base and parallel to one another, each mounting plate having a hole spaced from the base and an arcuate slot spaced further from the base than the hole.

20. The visor support device according to claim 19, further comprising a plurality of mounting elements, wherein the visor support has a flange extending from each side thereof, a pair of holes in each flange to oppose the hole and the arcuate slot of an opposing mounting plate, a first mounting element passing through the mounting plate and fixedly engaging a first hole in the opposing flange and a second mounting element passing through the arcuate slot and engaging a second hole in the opposing flange.

21. The visor support device according to claim 20, wherein the second mounting element further comprises means for fixing the visor support relative to the fixed member along the arcuate slot.

* * * * *